US010751772B2

(12) United States Patent
Hashimoto et al.

(10) Patent No.: US 10,751,772 B2
(45) Date of Patent: Aug. 25, 2020

(54) METHOD FOR PRODUCING STEEL SHEET PILE

(71) Applicant: NIPPON STEEL CORPORATION, Tokyo (JP)

(72) Inventors: Ryo Hashimoto, Tokyo (JP); Hiroshi Yamashita, Tokyo (JP); Yosuke Miura, Tokyo (JP); Masanori Kawai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/464,556

(22) PCT Filed: Jan. 25, 2018

(86) PCT No.: PCT/JP2018/002233
§ 371 (c)(1),
(2) Date: May 28, 2019

(87) PCT Pub. No.: WO2018/139521
PCT Pub. Date: Aug. 2, 2018

(65) Prior Publication Data

US 2020/0086367 A1 Mar. 19, 2020

(30) Foreign Application Priority Data

Jan. 27, 2017 (JP) ..... 2017-012994

(51) Int. Cl.
*B21B 1/082* (2006.01)

(52) U.S. Cl.
CPC ..... *B21B 1/082* (2013.01)

(58) Field of Classification Search
CPC ..... B21B 1/082; B21B 1/08
See application file for complete search history.

(56) References Cited

U.S. PATENT DOCUMENTS 4,334,419 A * 6/1982 Kishikawa ..... B21B 1/082 72/177

FOREIGN PATENT DOCUMENTS

CN 1174763 A 3/1998
CN 1608759 A 4/2005
(Continued)

OTHER PUBLICATIONS

Chinese Office Action and Search Report for corresponding Chinese Application No. 201880007578.6, dated Nov. 20, 2019.
(Continued)

*Primary Examiner* — Teresa M Ekiert
(74) *Attorney, Agent, or Firm* — Birch, Stewart, Kolasch & Birch, LLP

(57) ABSTRACT

To suppress the shape defect at a bite end part of a material to be rolled at a bending rolling stage of a rough rolling step to achieve improvements in productivity such as an improvement in yields and a decrease in crop in production of a steel sheet pile. A production method for producing a steel sheet pile by reducing a raw material in a rectangular cross-section, includes a rough rolling step, an intermediate rolling step, and a finish rolling step, wherein a rolling mill configured to perform the rough rolling step is provided with a caliber configured to perform bending rolling of extending a thickness center line length of the raw material and rolling and shaping the raw material from a rectangular cross-sectional shape to a substantially steel sheet pile cross-sectional shape, and wherein in the bending rolling, rolling that a reduction amount with respect to a predetermined section of a bite end part of the raw material is smaller than a reduction amount with respect to a part other than the predetermined section is performed.

5 Claims, 10 Drawing Sheets

(56) References Cited

FOREIGN PATENT DOCUMENTS

| | | | |
|---|---|---|---|
| CN | 101318197 | A | 12/2008 |
| JP | 55-50902 | A | 4/1980 |
| JP | 61-95703 | A | 5/1986 |
| JP | 1-178301 | A | 7/1989 |
| JP | 8-267112 | A | 10/1996 |
| JP | 11-314101 | A | 11/1999 |
| JP | 2006-192490 | A | 7/2006 |
| JP | 2015-142930 | A | 8/2015 |
| JP | 2016-203219 | A | 12/2016 |

OTHER PUBLICATIONS

International Search Report for PCT/JP2018/002233 dated Feb. 27, 2018.
Written Opinion of the International Searching Authority for PCT/JP2018/002233 (PCT/ISA/237) dated Feb. 27, 2018.

* cited by examiner

METHOD FOR PRODUCING STEEL SHEET PILE

CROSS-REFERENCE TO RELATED APPLICATIONS

This application is based upon and claims the benefit of priority of the prior Japanese Patent Application No. 2017-012994, filed in Japan on Jan. 27, 2017, the entire contents of which are incorporated herein by reference.

TECHNICAL FIELD

The present invention relates to a method for producing a steel sheet pile such as a hat-shaped steel sheet pile, a U-shaped steel sheet pile or the like.

BACKGROUND ART

Conventionally, production of a steel sheet pile having joints at both ends of a hat-shaped shape or a U-shaped shape is performed by a caliber rolling method. Known as a general process of the caliber rolling method is first heating a raw material to a redetermined temperature in a heating furnace and sequentially rolling the raw material by a rough rolling mill, an intermediate rolling mill, and a finish rolling mill including calibers.

According to the above-described general caliber rolling method, a domestically produced steel sheet pile product can be produced from a raw material in a rectangular cross-section in status quo. Concretely, for example, a hat-shaped steel sheet pile product called a 10H product having a cross-section second moment per 1 m of a wall width of 1.0 ($10^4$ $cm^4$/m) and a hat-shaped steel sheet pile product called a 25H product having a cross-section second moment per 1 m of a wall width of 2.5 ($10^4$ $cm^4$/m) are produced by the conventionally known general caliber rolling method.

In the case of producing the steel sheet pile from the raw material in a rectangular cross-section, it is known that various shape defects occur in a material to be rolled in its rolling step, and a solution therefore is devised. For example, Patent Document 1 discloses a technique of applying heavy reduction to a bite end part in order to suppress the occurrence of a bite shape at an end part flange of the material to be rolled in rolling and shaping. Besides, Patent Document 2 discloses a technique of suppressing the occurrence of a crop by forming a tip end part of the material to be rolled before rough rolling in production of shape steel. Besides, Patent Document 3 discloses a technique of imparting a preforming part shape to the end part of the material to be rolled in order to decrease the crop.

PRIOR ART DOCUMENT

Patent Document

[Patent Document 1] Japanese Laid-open Patent Publication No. S55-50902

[Patent Document 2] Japanese Laid-open Patent Publication No. H01-178301

[Patent Document 3] Japanese Laid-open Patent Publication No. 2006-192490

DISCLOSURE OF THE INVENTION

Problems to be Solved by the Invention

From the viewpoint of a cross-sectional performance of the steel sheet pile, the shape of a small thickness of the flange part with respect to the web part is employed. In the case of producing the steel sheet pile from the raw material in a rectangular cross-section using the caliber rolling method, the web part and the flange part are equal in thickness at the stage of the rectangular cross-sectional raw material, and a method is employed which shear-deforms the flange part at the bending rolling stage of forming the boundary between the web part and the flange part to bring the thickness ratio between the web part and the flange part to the thickness ratio of a product. In performing the above bending rolling, the shear deformation hardly occurs at the bite end part of the material to be rolled because a middle part (steady part) of the material to be rolled is undeformed, and metal of an arm part falls in the flange part, resulting in that the thicknesses of the flange part becomes large. At the flange part where the thicknesses becomes large, the drawing at the rolling later stage increases and possibly leads to growth of an unsteady part.

Further, the thickness of the flange part becomes large at the bite end part to differ the thickness ratio between the web part and the flange part in the longitudinal direction of the material to be rolled, and therefore variations in shape of a claw part in the longitudinal direction occur to possibly decrease the yields and enlarge the crop.

Furthermore, in the case of using a rectangular cross-sectional raw material having a large slab width, it is general to perform edging rolling before the above bending rolling, but there is a possibility that the increase in thickness of the flange part at the bending rolling stage becomes more prominent accompanying bulging deformation due to the edging rolling.

Note that the bulging deformation means bulge deformation occurring at the end parts in the width direction of the material to be rolled being the rectangular cross-sectional raw material in the edging rolling as illustrated in FIG. 18.

In the above techniques disclosed in Patent Documents 1 to 3, the shear deformation hardly occurs at the bite end part of the material to be rolled in the bending rolling, and there is nothing considered about the occurrence of the shape defect due to the fact that the thickness of the flange part becomes large. Note that the "bite end part of the material to be rolled" in this description indicates the tip end part in the rolling direction when the material to be rolled bites the roll, and a section of a predetermined length from the leading edge is set as the bite end part.

In view of the above circumstance, an object of the present invention is to provide a method for producing a steel sheet pile which suppresses the shape defect at a bite end part of a material to be rolled at a bending rolling stage of a rough rolling step to achieve improvements in productivity such as an improvement in yields and a decrease in crop in production of a steel sheet pile.

Means for Solving the Problems

To achieve the above object, according to the present invention, there is provided a production method for producing a steel sheet pile by reducing a raw material in a rectangular cross-section, the production method including a rough rolling step, an intermediate rolling step, and a finish rolling step, wherein a rolling mill configured to perform the rough rolling step is provided with a caliber configured to perform bending rolling of extending a thickness center line length of the raw material and rolling and shaping the raw material from a rectangular cross-sectional shape to a substantially steel sheet pile cross-sectional shape, and wherein in the bending rolling, light reduction rolling being rolling that a reduction amount with respect to a predetermined section of a bite end part of the raw material is smaller than a reduction amount with respect to a part other than the predetermined section is performed.

The bending rolling may be performed by reverse rolling in one pass or a plurality of passes, and the light reduction rolling may be applied to the one pass or the plurality of passes of the reverse rolling.

The bending rolling may be performed in a plurality of passes, the rolling in the plurality of passes may be divided into a preceding stage where a flange corresponding part of the raw material is not reduced and a later stage where the flange corresponding part of the raw material is reduced, and the light reduction rolling may be applied to a pass at the preceding stage of the plurality of passes.

The predetermined section of the bite end part of the raw material may be set to a section of 0.75 m or more from a bite end in a longitudinal direction of the raw material.

Steel sheet pile products of the same dimension may be produced using raw materials having a plurality of width dimensions as the raw material in the rectangular cross-section.

The steel sheet pile may be a U-shaped steel sheet pile.

The steel sheet pile may be a hat-shaped steel sheet pile.

Effect of the Invention

According to the present invention, it is possible to suppress the shape defect at a bite end part of a material to be rolled at a bending rolling stage of a rough rolling step to achieve improvements in productivity such as an improvement in yields and a decrease in crop in production of a steel sheet pile.

BEST MODE FOR CARRYING OUT THE INVENTION

Figure 1:
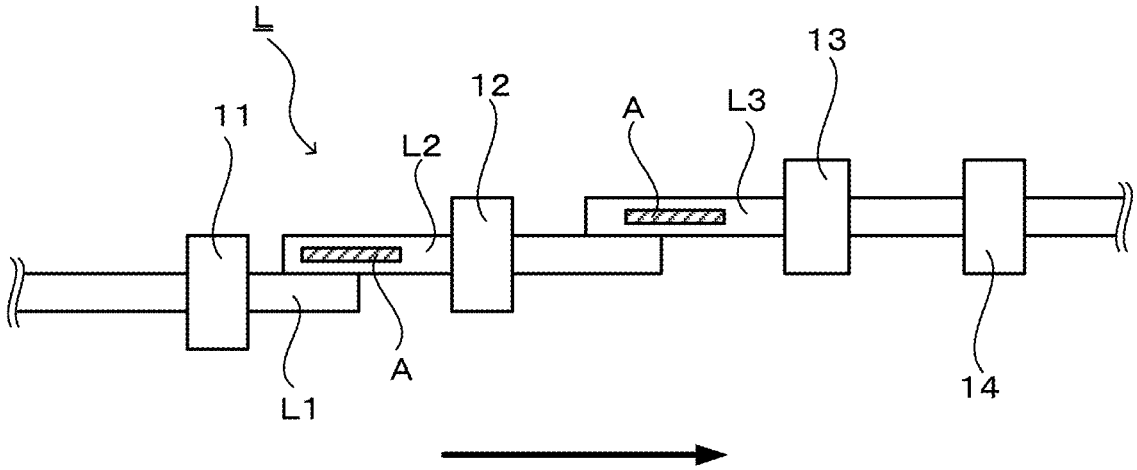
FIG. 1 A schematic explanatory view of a rolling line according to an embodiment of the present invention.

Hereinafter, an embodiment of the present invention will be explained referring to the drawings. Note that, in the description and the drawings, the same codes are given to components having substantially the same functional configurations to omit duplicated explanation. Note that the explanation will be made exemplifying a case of producing a hat-shaped steel sheet pile as an example of a steel sheet pile product.

Besides, in this embodiment, a material having a rectangular cross-section is called a raw material B and a material to be rolled made by reducing the raw material B into a substantially hat-shaped cross-sectional shape is called a material to be rolled A for convenience of explanation. More specifically, steel materials in the substantially hat-shaped cross-sectional shape to be passed on a rolling line L are generically called a material to be rolled A, and portions of the material to be rolled A are described by different names mentioned below. Here, the material to be rolled A is composed of a web corresponding part 3 corresponding to a web of a hat-shaped steel sheet pile product, flange corresponding parts 4, 5 connected to both end parts of the web corresponding part 3 respectively, aim corresponding parts 6, 7 formed at tip ends of the flange corresponding parts 4, 5 respectively, and joint corresponding parts 8, 9 formed at tip ends of the arm corresponding parts 6, 7. Further, at tip ends of the joint corresponding parts 8, 9, claw corresponding parts 8*a*, 9*a* are formed.

FIG. 1 is an explanatory view of the rolling line L for producing the hat-shaped steel sheet pile being a rolling facility according to the embodiment of the present invention, and rolling mills provided on the rolling line L. As illustrated in FIG. 1, on the rolling line L, a rough rolling mill (BD) 11, a first intermediate rolling mill (R1) 12, a second intermediate rolling mill (R2) 13, and a finish rolling mill (F) 14 are arranged in order. The rolling line L is composed of a plurality of lines L1 to L3, in which the line L1 and the line L2 are adjacent to each other and the line L2 and the line L3 are adjacent to each other. The lines L1 to L3 are coupled in series to partially overlap each other, and configured such that the material to be rolled A is translated from L1 to L2 or L2 to L3 in a width direction thereof to thereby proceed on the rolling line L.

Further, as illustrated in FIG. 1, the rough rolling mill 11 is arranged on the line L1, the first intermediate rolling mill 12 is arranged on the line L2, and the second intermediate rolling mill 13 and the finish rolling mill 14 are arranged on the third line L3. The lines L1 to L3 are configured to perform rolling with different materials to be rolled A placed thereon respectively, and perform rolling of a plurality of materials to be rolled A simultaneously in parallel on the rolling line L.

On the rolling line L illustrated in FIG. 1, a raw material having a rectangular cross-sectional shape (the raw material B, the later material to be rolled A) heated in a not-illustrated heating furnace is sequentially rolled in the rough rolling mill 11 to the finish rolling mill 14 to form into a hat-shaped steel sheet pile being a final product. In other words, a rough rolling step, an intermediate rolling step, and a finish rolling step are performed in this order on the raw material B (the material to be rolled A) to produce a final product.

Hereinafter, configurations of calibers provided in the rough rolling mill 11, the first intermediate rolling mill 12, the second intermediate rolling mill 13, and the finish rolling mill 14 arranged on the rolling line L (hereinafter, a plurality of rolling mills are described in an abbreviation manner such as the rough rolling mill 11 to the finish rolling mill 14) will be briefly explained referring to the drawings in order from the upstream of the rolling line L. Note that since the rough rolling mill 11, the first intermediate rolling mill 12, the second intermediate rolling mill 13, and the finish rolling mill 14 are conventionally generally used facilities, attention is focused on explanation of the configurations of the calibers but explanation of the detailed facility configurations and so on of the rolling mills are omitted in the following explanation in this description.

Further, calibers explained below referring to FIG. 2 to FIG. 9 are provided in the rolling mills of the rough rolling mill 11 to the finish rolling mill 14, and which caliber explained below is provided in which rolling mill can be appropriately changed usually depending on the conditions such as the facility status, product dimensions and so on in consideration of the productivity (efficiency and yields) and workability. Hence, the calibers are called a first caliber K1 to an eighth caliber K8 in this embodiment, and the calibers will be explained as those which may be provided in order from the upstream side of the rolling line L. Note that the shapes of the raw material B and the material to be rolled A which are to be reduced and shaped in the calibers are illustrated by a one-dotted chain line for reference in FIG. 3 to FIG. 9.

However, the configurations of the first caliber K1 to the eighth caliber K8 according to this embodiment explained below are not limited to the illustrated forms, but the increased/decreased arrangement of correction calibers for various calibers can be arbitrarily changed according to the conditions such as the facility status, product dimensions and so on. Note that in the first caliber K1 to the eighth caliber K8 explained below, rolling and shaping of the material to be rolled is preferably performed in reverse rolling (reversing rolling) in a plurality of passes, and the number of passes can be arbitrarily set.

Figure 2:
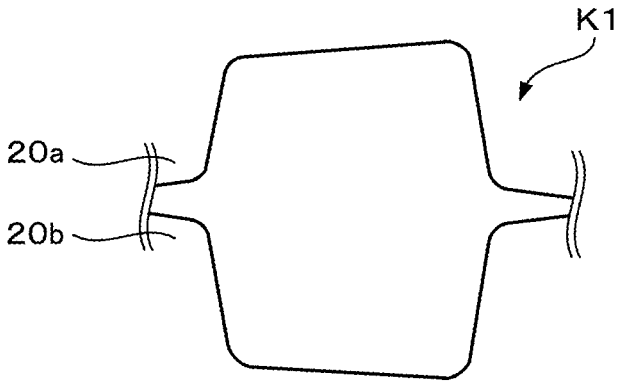
FIG. 2 A schematic explanatory view of the caliber shape of a first caliber.

FIG. 2 is a schematic explanatory view of the caliber shape of the first caliber K1. As illustrated in FIG. 2, the first caliber K1 is a box caliber composed of an upper caliber roll 20*a* and a lower caliber roll 20*b*, and caliber bottoms of the box caliber are in tapered shapes. The first caliber K1 imparts the tapered shapes to short side parts at end parts in the width direction of the raw material B in a rectangular cross-sectional shape and performs light reduction (so-called edging rolling) in the width direction in a state where the not-illustrated raw material B in a rectangular cross-sectional shape is made to stand up (a state of setting the width direction of a steel sheet pile in the vertical direction) in order to make a uniform width dimension in the longitudinal direction. Note that the reason why the tapered shapes are imparted to the end parts in the width direction of the raw material B in a rectangular cross-sectional shape is to cause the raw material B to preferably bites into the caliber shape of the later-described second caliber K2, and to stably perform desired reduction so as to form claws having desired material amounts at both end parts. The first caliber K1 illustrated in FIG. 2 is a caliber that performs so-called edging rolling, and the first caliber K1 is called an "edging caliber".

Figure 3:
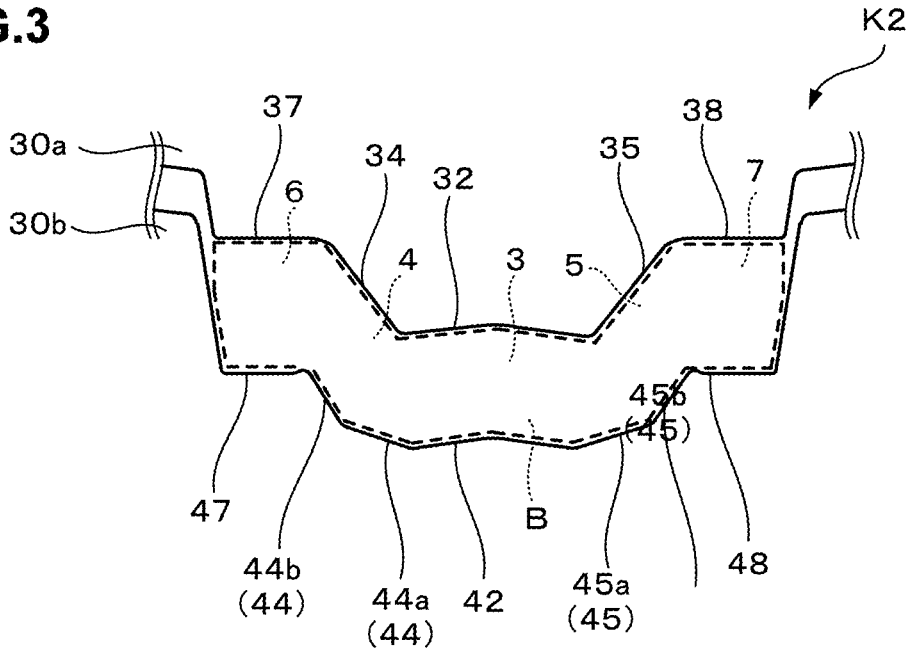
FIG. 3 A schematic explanatory view of the caliber shape of a second caliber.

Besides, FIG. 3 is a schematic explanatory view of the caliber shape of the second caliber K2. As illustrated in FIG. 3, the second caliber K2 is composed of an upper caliber roll 30*a* as a projection roll and a lower caliber roll 30*b* as a groove roll, and the second caliber K2 performs reduction on the whole raw material B (the later material to be rolled A) in a rectangular cross-sectional shape subjected to the edging rolling in the above first caliber K1. Here, the raw material B is in a state of being made to stand up in the reduction in the first caliber K1, and the raw material B is thereafter rotated 90° or 270° and subjected to reduction in the second caliber K2 in a state where the width direction of the raw material B is set in the horizontal direction (a state of setting the width direction of the steel sheet pile in the horizontal direction), whereby rolling and shaping is performed to form a cross section in an intermediate shape between the rectangular cross-sectional shape and the substantially hat-shaped cross-sectional shape. In this description, the rolling and shaping in the second caliber K2 is also described as "bending rolling".

The upper caliber roll 30*a* is composed of a web facing part 32 facing the upper surface of the web corresponding part 3 of the raw material B, flange facing parts 34, 35 facing the upper surfaces of the flange corresponding parts 4, 5, and arm facing parts 37, 38 facing the upper surfaces of the arm corresponding parts 6, 7.

On the other hand, the lower caliber roll 30*b* is composed of a web facing part 42 facing the lower surface of the web corresponding part 3 of the raw material B, flange facing parts 44, 45 facing the lower surfaces of the flange corresponding parts 4, 5, and arm facing parts 47, 48 facing the lower surfaces of the arm corresponding parts 6, 7. Further, the flange facing part 44, 45 are composed of a plurality of parts different in inclination, and composed of gently inclined flange facing portions 44*a*, 45*a* connected to the web facing part 42 and steeply inclined flange facing portions 44*b*, 45*b* connected to the arm facing parts 47, 48.

Figure 4:
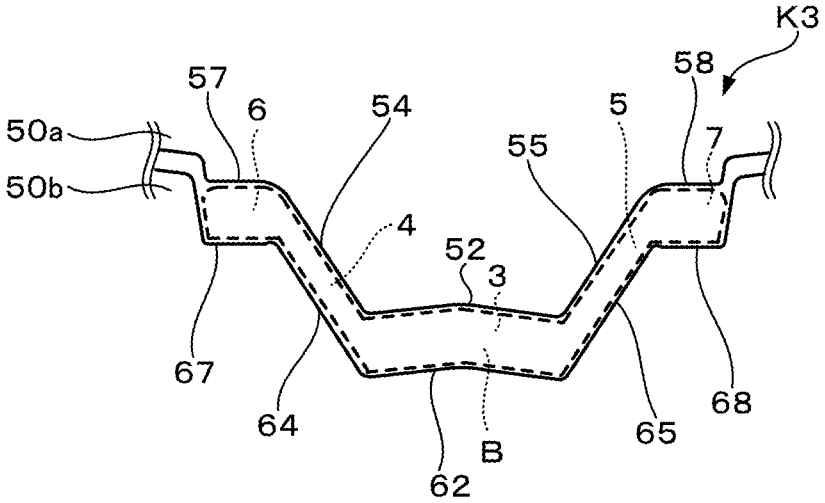
FIG. 4 A schematic explanatory view of the caliber shape of a third caliber.

Further, FIG. 4 is a schematic explanatory view of the caliber shape of the third caliber K3. As illustrated in FIG. 4, the third caliber K3 is composed of an upper caliber roll 50*a* as a projection roll and a lower caliber roll 50*b* as a groove roll, and the third caliber K3 performs further reduction on the raw material B (the later material to be rolled A) subjected to the shaping in the second caliber K2 and performs reduction on the whole raw material B to form the cross section from the intermediate shape (the intermediate shape between the rectangular cross-sectional shape and the substantially hat-shaped cross-sectional shape) to the substantially hat-shaped cross-sectional shape.

Note that the substantially hat-shaped cross-sectional shape mentioned here means a cross-sectional shape made by performing reduction to such a degree that the raw material B has clear boundaries of a portion corresponding to a web (web corresponding part 3), portions corresponding to flanges (flange corresponding parts 4, 5), and portions corresponding to arms (arm corresponding parts 6, 7), and does not always mean the cross-sectional shape shaped up to fine shapes such as joint shapes and so on.

The upper caliber roll 50*a* is composed of a web facing part 52 facing the upper surface of the web corresponding part 3 of the raw material B, flange facing parts 54, 55 facing the upper surfaces of the flange corresponding parts 4, 5, and arm facing parts 57, 58 facing the upper surfaces of the arm corresponding parts 6, 7.

On the other hand, the lower caliber roll 50*b* is composed of a web facing part 62 facing the lower surface of the web corresponding part 3 of the raw material B, flange facing parts 64, 65 facing the lower surfaces of the flange corresponding parts 4, 5, and arm facing parts 67, 68 facing the lower surfaces of the arm corresponding parts 6, 7.

Figure 5:
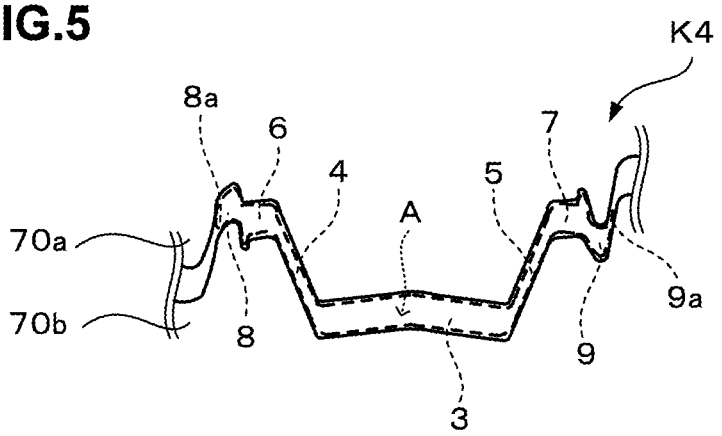
FIG. 5 A schematic explanatory view of the caliber shape of a fourth caliber.

FIG. 5 is a schematic explanatory view of the caliber shape of the fourth caliber K4. As illustrated in FIG. 5, the fourth caliber K4 is composed of an upper caliber roll 70*a* as a projection roll and a lower caliber roll 70*b* as a groove roll, and the fourth caliber K4 forms the claw corresponding parts and performs thickness reduction and forming (thickness drawing rolling) on the whole material to be rolled A which is formed into a shape closer to the hat-shaped steel sheet pile product.

Figure 6:
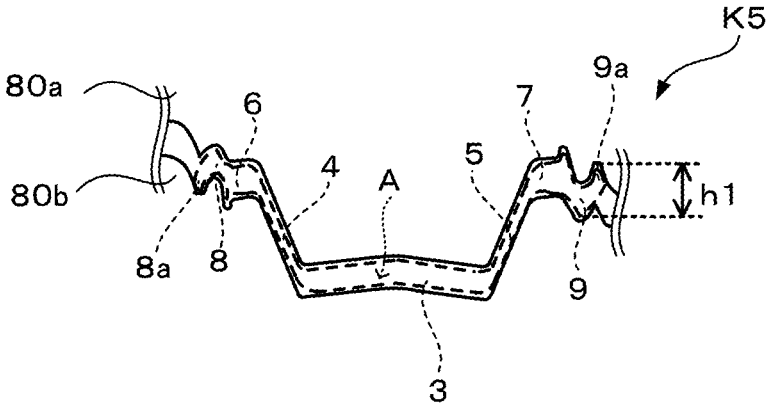
FIG. 6 A schematic explanatory view of the caliber shape of a fifth caliber.

FIG. 6 is a schematic explanatory view of the caliber shape of the fifth caliber K5. As illustrated in FIG. 6, the fifth caliber K5 is composed of an upper caliber roll 80*a* as a projection roll and a lower caliber roll 80*b* as a groove roll, and the fifth caliber K5 performs thickness reduction and forming on the whole material to be rolled A. Specifically, claw thickness forming of adjusting heights of the claw corresponding parts 8*a*, 9*a* (a height hl in the vertical direction in the drawing) to uniform heights of the two claw corresponding parts 8*a*, 9*a* and thickness reduction of the whole material to be rolled A are simultaneously performed. Note that the forming of uniforming the heights of the claw corresponding parts 8*a*, 9*a* as in the fifth caliber K5 is called a claw forming step, and the caliber for performing the claw forming step is called a claw forming caliber.

Figure 7:
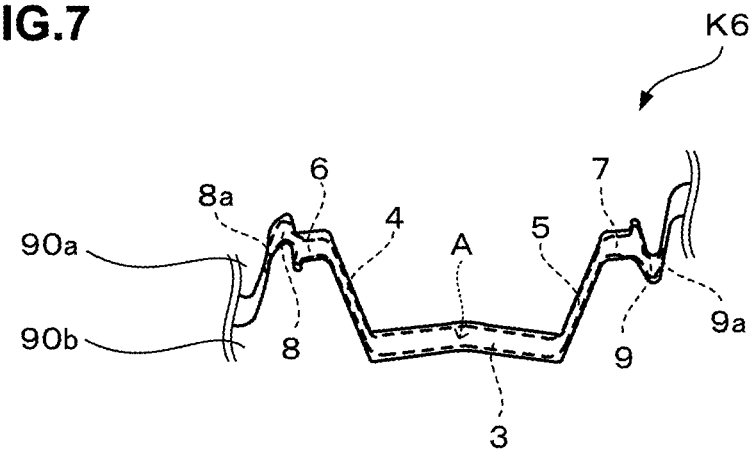
FIG. 7 A schematic explanatory view of the caliber shape of a sixth caliber.

FIG. 7 is a schematic explanatory view of the caliber shape of the sixth caliber K6. As illustrated in FIG. 7, the sixth caliber K6 is composed of an upper caliber roll 90*a* as a projection roll and a lower caliber roll 90*b* as a groove roll, and the sixth caliber K6 performs thickness reduction and forming (thickness drawing rolling) on the whole material to be rolled A.

Figure 8:
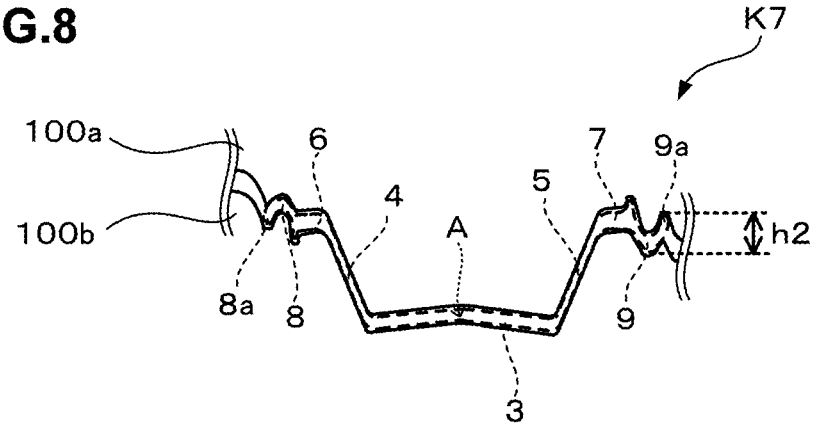
FIG. 8 A schematic explanatory view of the caliber shape of a seventh caliber.

FIG. 8 is a schematic explanatory view of the caliber shape of the seventh caliber K7. As illustrated in FIG. 8, the seventh caliber K7 is composed of an upper caliber roll 100*a* as a projection roll and a lower caliber roll 100*b* as a groove roll, and the seventh caliber K7 performs thickness reduction and forming on the whole material to be rolled A, and specifically, claw thickness forming of adjusting heights of the claw corresponding parts 8*a*, 9*a* (a height h2 in the vertical direction in the drawing) to uniform heights of the two claw corresponding parts 8*a*, 9*a* is performed. However, the thickness reduction amount in the seventh caliber K7 is smaller than that in the sixth caliber K6 which actively performs the thickness reduction on the whole material to be rolled A.

Figure 9:
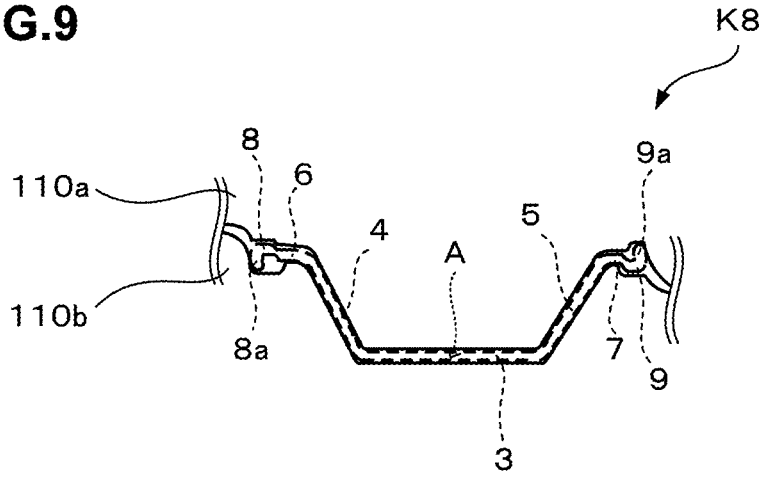
FIG. 9 A schematic explanatory view of the caliber shape of an eighth caliber.

FIG. 9 is a schematic explanatory view of the caliber shape of the eighth caliber K8. As illustrated in FIG. 9, the eighth caliber K8 is composed of an upper caliber roll 110*a* as a projection roll and a lower caliber roll 110*b* as a groove roll, and the eighth caliber K8 performs bending forming of the joint corresponding parts 8, 9 of the material to be rolled A and shaping of the whole material to be rolled A by light rolling. Specifically, joint forming of bending the whole joint corresponding parts 8, 9 including the claw corresponding parts 8*a*, 9*a* into joint shapes of the product. Thus, the eighth caliber K8 forms the material to be rolled A up to the shape of the hat-shaped steel sheet pile product. Note that the caliber for bending forming the whole joint corresponding parts 8, 9 like the eighth caliber K8 is called a finishing caliber.

The caliber shapes and functions of the first caliber K1 to the eighth caliber K8 have been explained above referring to FIG. 2 to FIG. 9. As described above, the caliber rolling method for the hat-shaped steel sheet pile includes the rough rolling step, the intermediate rolling step, and the finish rolling step and, for example, the rough rolling step and the intermediate rolling step are performed in sequence in the calibers of the first caliber K1 to the seventh caliber K7, and the finish rolling step is performed in the eighth caliber K8. Here, all of the caliber shapes of the fourth caliber K4 to the eighth caliber K8 are in the substantially hat-shaped cross-sectional shape, and provided in shapes closer to the product shape as they are calibers at later stages. In other words, the shape of the eighth caliber K8 where the finish rolling being the final step is performed is in the substantially hat-shaped steel sheet pile product shape.

Note that the rough rolling mill (BD) 11, the first intermediate rolling mill (R1) 12, the second intermediate rolling mill (R2) 13, and the finish rolling mill (F) 14 are arranged in order on the rolling line L in this embodiment, and the above-described first caliber K1 to eighth caliber K8 are dispersedly provided in an arbitrary configuration in the rolling mills. One example can be a configuration in which the first caliber K1 to the third caliber K3 are provided in the rough rolling mill 11, the fourth caliber K4 and the fifth caliber K5 are provided in the first intermediate rolling mill 12, the sixth caliber K6 and the seventh caliber K7 are provided in the second intermediate rolling mill 13, and the eighth caliber K8 is provided in the finish rolling mill 14. However, the caliber configuration in the present invention is not limited to such s configuration.

The present inventors found problems as explained in the following 1) to 3) in a conventional shaping step in the second caliber K2 at the rough rolling step for shaping the substantially hat-shaped cross-sectional shape from the raw material B in the rectangular cross-sectional shape, and earnestly carried out studies on a technique for solving the problems.

1) At the time when rolling and shaping the rectangular cross-sectional raw material (raw material B) in the second caliber K2, the thickness of the raw material B before shaping is equal in the web part and the flange part, and the rolling and shaping of bringing the thickness ratio between the web part and the flange part to a product thickness ratio is performed mainly by shear deformation. Since a part near the middle in the longitudinal direction of the material to be rolled (a so-called steady part) is undeformed at this time, shear deformation hardly occurs at the bite end, resulting in that the thickness of the flange part becomes large. The thickness of the flange part becoming large makes large flange drawing in rolling at a later stage and there is a concern of growth of an unsteady part (a so-called crop).
2) The thickness of the flange part becomes large in the bending rolling to cause such a property that the thickness ratio between the web part and the flange part differs in the longitudinal direction of the material to be rolled, thus possibly causing variations in the shape of the claw parts (claw corresponding parts 8*a*, 9*a*) in the longitudinal direction of the material to be rolled.
3) In the case of using a raw material having a larger raw material width (a so-called slab width) than the conventional one as the raw material B in the rectangular cross-sectional shape, the material to be rolled is subjected to bulging deformation in the edging rolling (the above-described rolling by the first caliber K1), the shear deformation in the bending rolling is further inhibited, possibly making the shape defect that the thickness of the flange part becomes large more prominent. In other words, it is difficult to use a raw material having a larger raw material width than the conventional one, leading to a limitation of the allowable raw material dimension.

Figure 10:
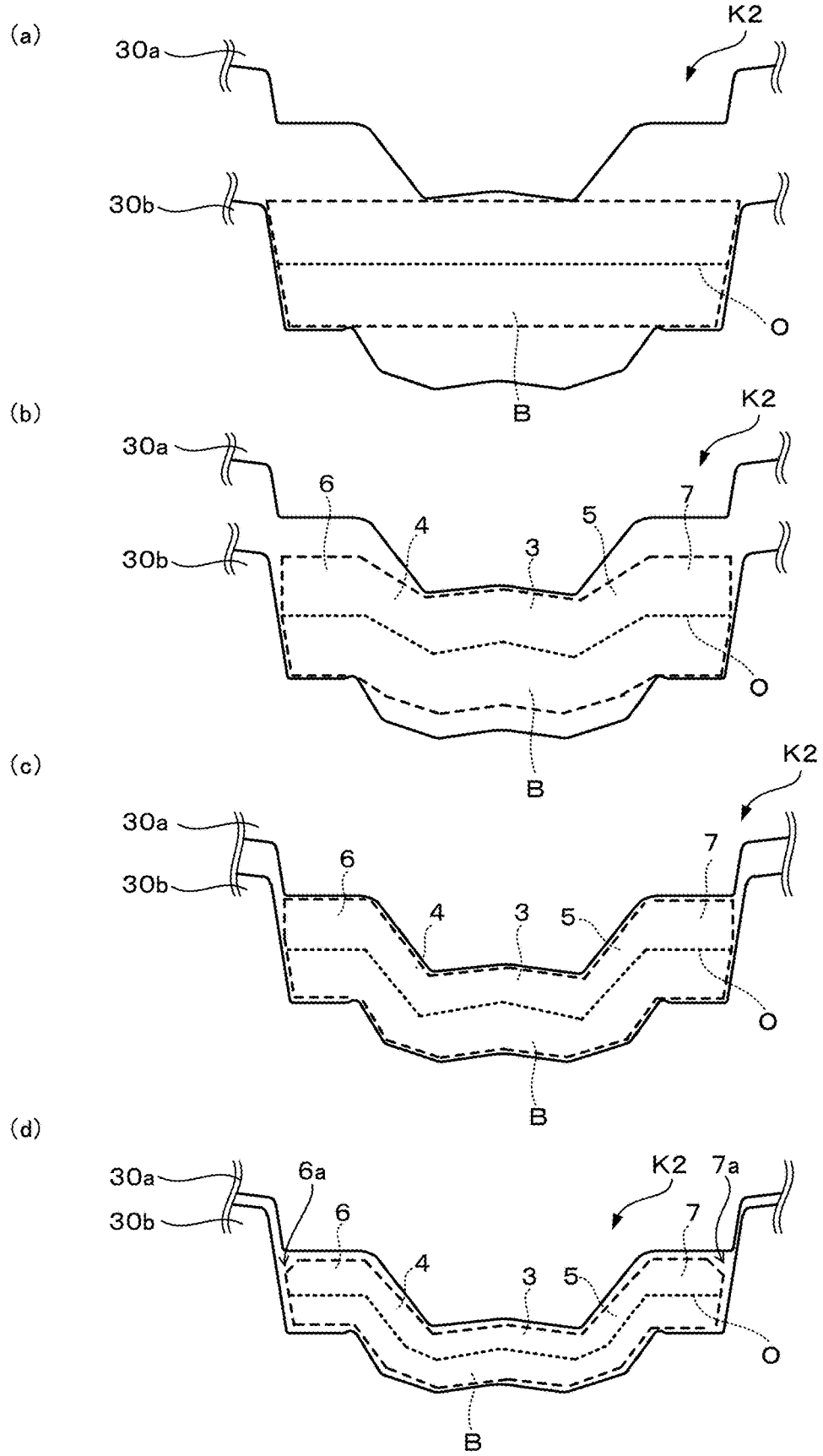
FIG. 10 A schematic explanatory view of bending rolling in the second caliber.

Here, the above problems 1) to 3) will be explained referring to the drawings. FIG. 10 is a schematic explanatory view of the bending rolling in the second caliber K2, and (a) to (d) illustrate the processes of the bending rolling performed in a plurality of passes in order.

As illustrated in FIG. 10(*a*), the upper caliber roll 30*a* and the lower caliber roll 30*b* come into contact with the upper and lower surfaces of the raw material B subjected to the edging rolling in the first caliber K1. Then, as illustrated in FIGS. 10(*b*), (*c*), (*d*), the bending rolling proceeds. In this event, there are a stage (a pass at a preceding stage) where the flange corresponding parts 4, 5 are not reduced as illustrated in FIG. 10(*b*), and a stage (a pass at a later stage) where the flange corresponding parts 4, 5 are reduced as illustrated in FIG. 10(*c*) to (*d*).

Figure 13:
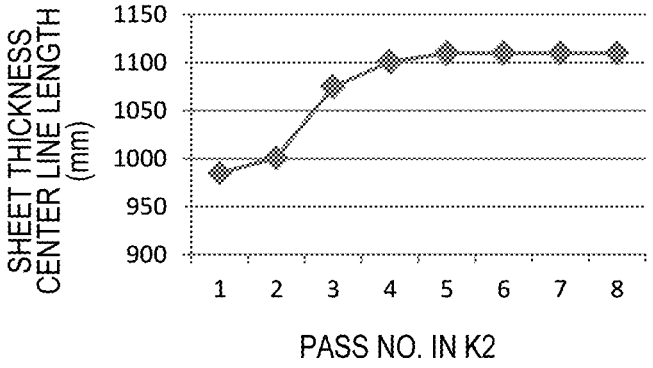
FIG. 13 A graph illustrating the relation between the pass No. and the line length in the case of performing the bending rolling in a plurality of passes.

The bending rolling is the rolling of extending the length of a thickness center line O of the raw material B (hereinbelow, also described simply as a line length) indicated by a chain line O in FIG. 10, and it is known that the line length extends as it goes to the later stage in FIG. 10(*a*) to (*d*) as a matter of principle. FIG. 13 is a graph illustrating the relation between the pass No. and the line length in the case of performing the bending rolling in a plurality of passes. As illustrated in FIG. 13, it is known that the rolling of extending the line length in initial several passes (for example, 1 to 5 passes) is performed and the line length hardly varies in the subsequent passes in the bending rolling. In such a case, the phenomenon that the shear deformation hardly occurs and the flange thickness becomes large as above-described in the above problem 1) occurs particularly prominently in the rolling of extending the line length. This is because the shape difference between the bite end part and the undeformed part (the so-called steady part) near the middle in the longitudinal direction of the material to be rolled is larger in the rolling of extending the line length.

Figure 14:
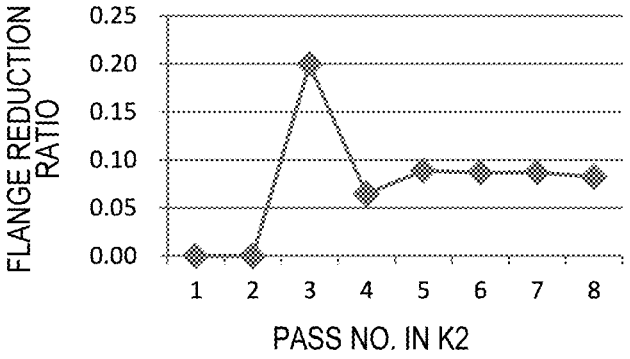
FIG. 14 A graph illustrating the pass No. and the flange reduction ratio in each of passes in the case of performing the bending rolling in a plurality of passes.

Besides, FIG. 14 is a graph illustrating the pass No. and the flange reduction ratio in each of passes in the case of performing the bending rolling in a plurality of passes. As illustrated in FIG. 14, there are a stage where the flange reduction ratio is 0 (not reduced) (for example, 1 to 2 passes) and a stage where the flange reduction ratio is a positive value (reduced) (for example, 3 and subsequent passes). In such a case, the phenomenon that the shear deformation hardly occurs and the flange thickness becomes large as described in the above problem 1) occurs particularly prominently at the stage where the flange reduction ratio is 0. This is because start of the flange reduction means almost finish of the rolling (bending forming) of extending the line length and the rolling after the start of the flange reduction is mainly thickness reduction. Note that when the flange reduction is started, the unsteady part (flange lead amount) dominantly grows in passing the tail end of the material to be rolled.

It is known that the rolling and shaping of the material to be rolled accompanying the bending rolling performed at the steps illustrated in FIG. 10 is mainly shear deformation, but since the steady part is undeformed at the bite end part, the rolling and shaping hardly becomes shear deformation, so that metal of the arm corresponding parts 6, 7 fall in the flange corresponding parts 4, 5, resulting in that the thicknesses of the flange corresponding parts 4, 5 become large. Accompanying this, material chipped portions 6*a*, 7*a* as illustrated in FIG. 10(*d*) are formed at side surfaces of the arm corresponding parts 6, 7. When such a step is performed on the bite parts, the problems as described in the above 1) to 3) may occur.

Figure 11:
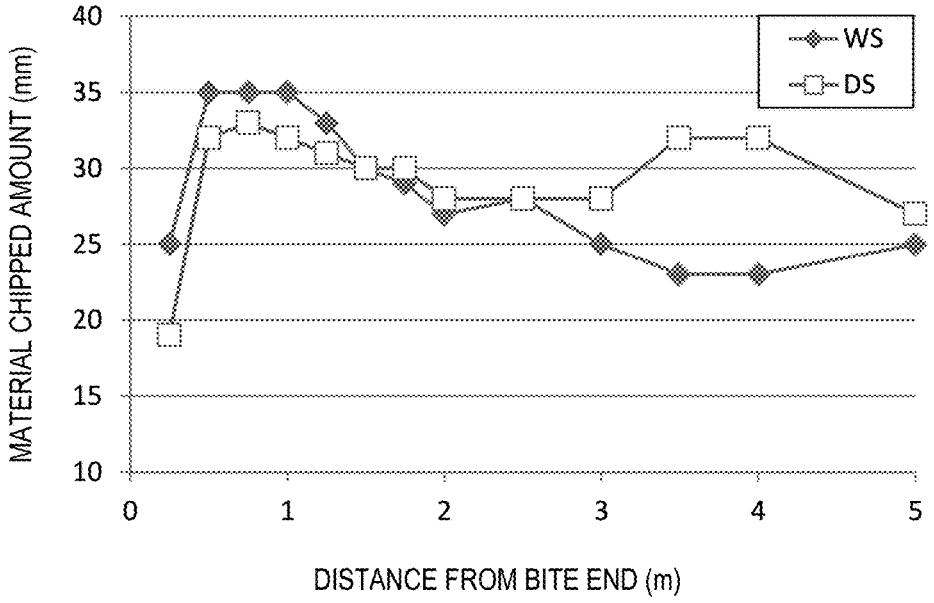
FIG. 11 A graph illustrating the relation between the distance from a bite leading edge in the bending rolling and the material chipped amount of a material chipped portion.

FIG. 11 is a graph illustrating the relation between the distance from the bite leading edge in the bending rolling and the material chipped amount of the above-described material chipped portions 6*a*, 7*a*. Note that FIG. 11 is data in the bending rolling in the case of rolling and shaping a so-called 25H product, and the length in the width direction of the material to be rolled was measured as the material chipped amount. Besides, in FIG. 11, a range of the distance from the bite end of 0 to 5 m in the case of the entire length of the material to be rolled of about 10 m is illustrated, and WS, DW indicate both ends in the width direction of the material to be rolled (raw material B).

As illustrated in FIG. 11, the material chipped amount varies depending on the distance from the bite leading edge, showing that variations occur in the shape of the claw parts (claw corresponding parts 8*a*, 9*a*) in the longitudinal direction of the material to be rolled as explained in the above 2). In other words, it is found also from the data in FIG. 11 that the variations in the claw part shape possibly decrease the yields and enlarge the crop.

In view of the above problems 1) to 3) explained referring to FIG. 10, FIG. 11, the present inventors has considered that the shape defect is prominent at the bite end part of the material to be rolled, and devised a technique of opening a roll gap between the upper and lower caliber rolls as compared with a roll gap with respect to the steady part at a preferable timing in part or all of passes at the bending rolling, and performing light reduction rolling only on the bite end part to thereby suppress the occurrence of the shape defect at the bite end part.

Figure 12:
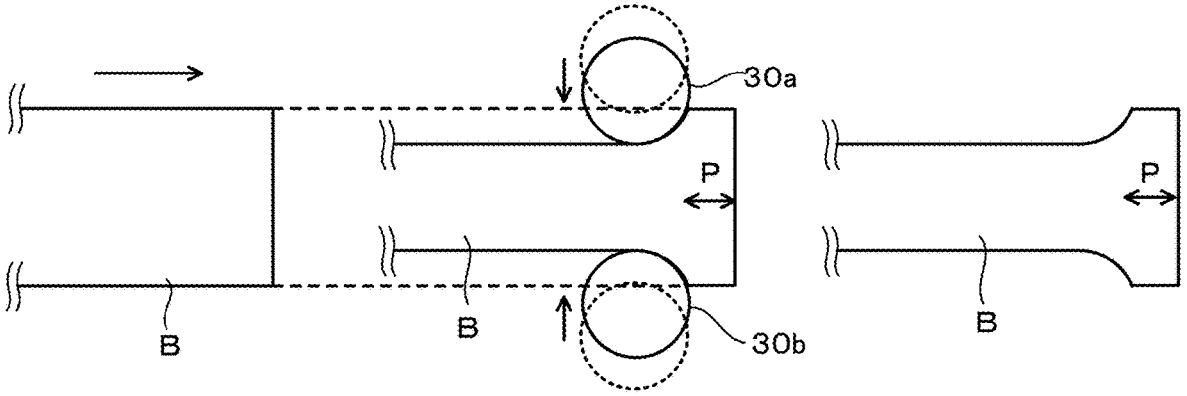
FIG. 12 A schematic explanatory view regarding light reduction rolling of a bite end part.

FIG. 12 is a schematic explanatory view regarding the light reduction rolling of the bite end part and, specifically, is an explanatory view in the case of opening the roll gap in the rolling and shaping in the second caliber K2 (the upper and lower caliber rolls 30*a*, 30*b*) and performing the light reduction rolling on the bite end part, and is a schematic side view as seen from the side surface. Note that FIG. 12 illustrates the raw material B before the rolling and shaping in an arbitrary pass (left side in the drawing), just after start of the rolling and shaping in the pass (middle in the drawing), and after finish of the rolling and shaping in the pass (right side in the drawing) for explanation.

As illustrated in FIG. 12, it is desirable to open the roll gap at start of shaping as compared with the roll gap at the rolling of the steady part in the second caliber K2, narrow the roll gap after the raw material B passes through the caliber rolls only for a predetermined section P of the bite end part, and perform rolling and shaping on the steady part.

In the bending rolling performed as described above, the bending rolling is performed in a state where the reduction amount is smaller in the predetermined section P of the bite end part than that at the steady part (namely, light reduction). This can suppress occurrence of the shape defect at the bite end part as explained as the above problems 1) to 3).

The light reduction at the bending rolling explained here may be applied to all or part of passes when the bending rolling is performed in a plurality of passes. Further, at the reversing rolling (reverse rolling), applying the light reduction rolling to the bite end part of the material to be rolled in each of the passes enables suppression of the shape defect. Concrete examples of the pass schedule in applying the light reduction rolling will be described later in examples.

Besides, the predetermined section P is desirably set to a range of the bite end except a range called the so-called steady part in the longitudinal direction of the material to be rolled, but can be arbitrarily set. Note that concrete examples of the predetermined section P will be described later in examples.

Note that for performing the above-described light reduction rolling, it is desirable that the rolling mill provided with the second caliber K2 is configured to include a mechanism for changing the roll gap of the caliber roll. An example of the mechanism can be a hydraulic reduction mechanism.

According to the above-described method for producing the steel sheet pile according to this embodiment, the bending rolling is performed in a state where the reduction amount in the predetermined section P of the bite end is smaller than that in the other section. This can suppress occurrence of the shape defect at the bite end to improve the productivity such as an improvement in yields and a decrease in crop.

Further, it is possible to suppress the property that the thickness ratio between the web part and the flange part differs in the longitudinal direction of the material to be rolled, thereby solving the problem that variations occur in the shape of the claw parts (claw corresponding parts 8*a*, 9*a*) in the longitudinal direction of the material to be rolled so as to uniform the claw part shapes.

Further, even if a raw material having a larger raw material width (so-called slab width) than the conventional one is used and the material to be rolled is subjected to bulging deformation at the edging rolling, the shear deformation at the bending rolling is hardly inhibited and the shape defect that the thickness of the flange part becomes large is suppressed, thus enabling use of the raw material having a larger raw material width than the conventional one and enlargement of the allowable raw material dimension. For example, even in the case of producing the same steel sheet pile product, it becomes possible to perform production using rectangular cross-sectional raw materials having various kinds of width dimensions.

Note that the technique of applying the light reduction rolling in the above-described bending rolling may be applied to all or part of passes in the case where the bending rolling is performed in a plurality of passes. When the raw material B is reversed in the bending rolling in the plurality of passes, the occurrence of the shape defect at both end parts in the longitudinal direction of the raw material B can be suppressed by applying the light reduction rolling on the bite end of the raw material B in each of the passes.

One example of the embodiment of the present invention has been described above, but the present invention is not limited to the illustrated embodiment. It should be understood that various changes and modifications are readily apparent to those skilled in the art within the scope of the spirit as set forth in claims, and those should also be covered by the technical scope of the present invention.

For example, though the case of producing the hat-shaped steel sheet pile product is illustrated and explained as an example in the above embodiment, the application range of the present invention is not limited to this. Concretely, application of the present invention in the method for producing various steel sheet pile products produced using a rectangular cross-sectional raw material can suppress the shape defect at the bite end parts. However, the hat-shaped steel sheet pile is a steel sheet pile characterized by a large cross-sectional structure and is large in height in the shape after rolling by the second caliber for performing the bending rolling into the substantially steel sheet pile cross-sectional shape and large in deformation amount of the line length as compared with a standard steel sheet pile in terms of the characteristic. Therefore, the technique of the present invention is useful, in particular, in production of the hat-shaped steel sheet pile.

Further, the case of performing rolling of the hat-shaped steel sheet pile in the configuration that the projection rolls are arranged as the upper caliber rolls and the groove rolls are arranged as the lower caliber rolls of a series of caliber train in FIG. 3 to FIG. 10, that is, a so-called U-attitude rolling has been illustrated and explained in the above embodiment. However, the rolling of the hat-shaped steel sheet pile may be performed in the configuration that the projection rolls are arranged as the lower caliber rolls and the groove rolls are arranged as the upper caliber rolls for part or all of such a series of caliber train, that is, a so-called inverted U-attitude rolling.

EXAMPLES

Example 1

In producing a hat-shaped steel sheet pile called a so-called 25H product having a cross-section second moment per 1 m of a wall width of 2.5 ($10^4$ $cm^4/m$) by a caliber rolling method as Example 1 of the present invention, the relation between the length of a section where the light reduction rolling was applied (the above-described predetermined section P) and the length of an unsteady part at the bite end after the bending rolling in the case of applying the technique according to the present invention explained in the above embodiment (the light reduction rolling in the predetermined section) in the bending rolling was measured. Note that the bending rolling pass schedule according to Example 1 is as listed in the following Table 1.

TABLE 1

| PASS NO. | ROLL GAP (mm) | WEB THICKNESS (mm) | FLANGE REDUCTION RATIO | BITE LIGHT ROLLING |
|---|---|---|---|---|
| 1 | 405 | 253 | 0.000 | APPLIED |
| 2 | 365 | 253 | 0.000 | APPLIED |
| 3 | 280 | 253 | 0.199 | — |
| 4 | 259 | 253 | 0.065 | — |
| 5 | 232 | 232 | 0.089 | — |
| 6 | 208 | 208 | 0.087 | — |
| 7 | 186 | 186 | 0.087 | — |
| 8 | 167 | 167 | 0.082 | — |

Figure 15:
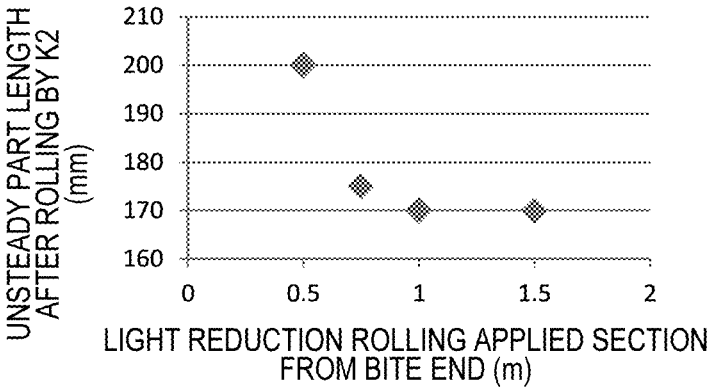
FIG. 15 A graph relating to Example 1.

FIG. 15 is a graph relating to Example 1 and illustrates the relation between the length of the section where the light reduction rolling is applied and the length of the unsteady part at the bite end after the bending rolling. As illustrated in FIG. 15, in the case of setting the application section of the light reduction rolling to 0.75 m or more, the length of the unsteady part after the rolling by the second caliber K2 is suppressed to a low level such as about 175 mm or less. On the other hand, in the case of setting the application section of the light reduction rolling to less than 0.75 m, the length of the unsteady part after the rolling by the second caliber K2 increases to be large such as about 200 mm or more in the section of 0.5 m, showing that the length where the shape defect occurs at the bite end part increases. The measurement result shows that setting a section of 0.75 m or more from the bite end part in the longitudinal direction of the material to be rolled as the application section of the light reduction rolling can effectively suppress the length of the unsteady part.

Example 2

In producing a hat-shaped steel sheet pile called a so-called 25H product having a cross-section second moment per 1 m of a wall width of 2.5 ($10^4$ $cm^4/m$) by a caliber rolling method as Example 2 of the present invention, the flange leading amount with respect to the web after the bending rolling in the case of performing the bending rolling without applying the technique of the present invention and the flange leading amount with respect to the web after the bending rolling in the case of applying the technique according to the present invention (the light reduction rolling in the predetermined section (1 m from the bite end part)) were measured and subjected to comparison examination. Note that the bending rolling pass schedule according to Example 2 is as listed in the following Table 2, and Level 1 in the table is the prior art and Level 2 is the technique of the present invention, in which the light reduction rolling (application of the bite light reduction) was carried out in the first pass and the second passes of the bending rolling in applying the technique of the present invention. Further, in the measurement of Example 2, the width (slab width) of the rectangular cross-sectional raw material was changed from 980 mm to 1150 mm and the flange lead amount was measured in each case.

Here, the flange lead amount indicates the length of the flange part extending more than the web part in the longitudinal direction of the material to be rolled after the bending rolling, and an increase in the flange lead amount leads to an increase of the unsteady part (shape defect part).

TABLE 2

| | | | ROLLING CONDITION | |
|---|---|---|---|---|
| PASS NO. | ROLL GAP (mm) | WEB THICKNESS (mm) | LEVEL 1 (PRIOR ART) | LEVEL 2 (TECHNIQUE OF PRESENT INVENTION |
| 1 | 405 | 253 | — | BITE LIGHT REDUCTION APPLIED |
| 2 | 365 | 253 | — | BITE LIGHT REDUCTION APPLIED |
| 3 | 280 | 253 | — | — |
| 4 | 259 | 253 | — | — |
| 5 | 232 | 232 | — | — |
| 6 | 208 | 208 | — | — |
| 7 | 186 | 186 | — | — |
| 8 | 167 | 167 | — | — |

Figure 16:
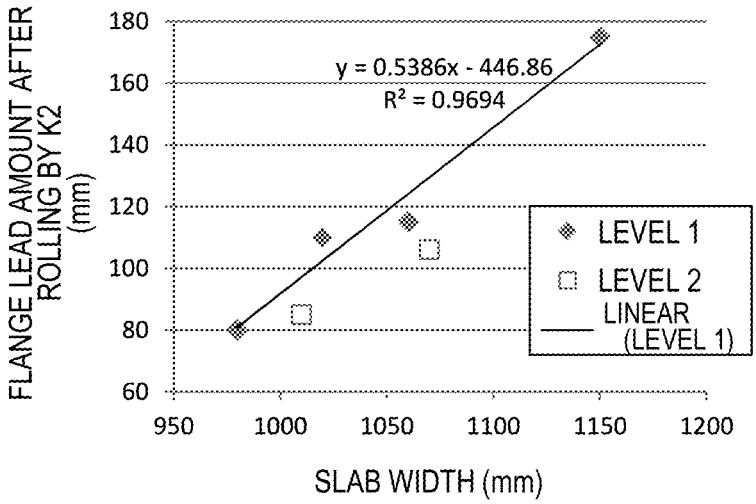
FIG. 16 A graph relating to Example 2.

FIG. 16 is a graph relating to Example 2 and indicating the flange lead amount when setting the width (slab width) of the rectangular cross-sectional raw material to 980 mm to 1150 mm and performing the bending rolling in the pass schedule in Table 2 in each of the cases. As illustrated in FIG. 16, it is found that even when using the raw materials having substantially the same slab width, the decrease of the flange lead amount after the bending rolling is achieved when applying the technique of the present invention. For example, it is found that in each of the case of using a raw material having a slab width of 1010 mm and the case of using a raw material having a slab width of 1070 mm, the flange lead amount can be decreased by about 20% in terms of length.

It is also found from FIG. 16 that the flange lead amount in the case of performing the bending rolling by the prior art using the raw material having a slab width of 980 mm and the flange lead amount in the case of performing the bending rolling by applying the technique of the present invention using the raw material having a slab width of 1010 mm are substantially the same amount (about 80 mm). Similarly, it is found that the flange lead amount in the case of performing the bending rolling by the prior art using the raw material having a slab width of 1020 mm and the flange lead amount in the case of performing the bending rolling by applying the technique of the present invention using the raw material having a slab width of 1070 mm are substantially the same amount (about 110 mm). Consequently, it was found that applying the technique of the present invention enables use of a raw material having a larger raw material width than the conventional one and enlargement of the allowable raw material dimension without growing the unsteady part.

Example 3

In producing a hat-shaped steel sheet pile called a so-called 25H product having a cross-section second moment per 1 m of a wall width of 2.5 ($10^4$ $cm^4/m$) by a caliber rolling method as Example 3 of the present invention, the claw height and the claw caliber width after the claw forming step in the case of performing the bending rolling without applying the technique of the present invention and the claw height and the claw caliber width after the claw forming step in the case of applying the technique according to the present invention (the light reduction rolling in the predetermined section) were measured and subjected to comparison examination.

Figure 17:
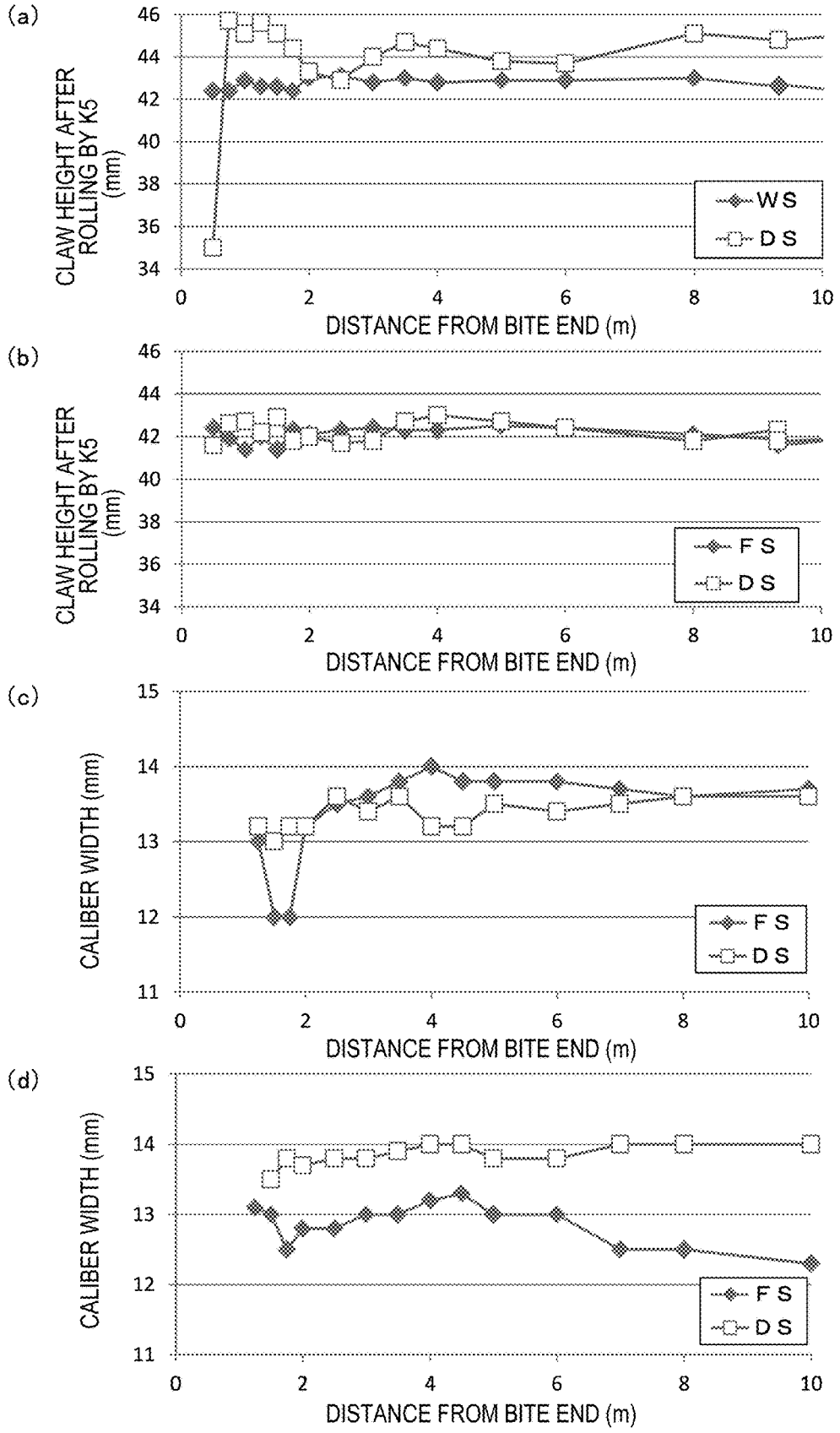
FIG. 17 A graph relating to Example 3.
Figure 18:
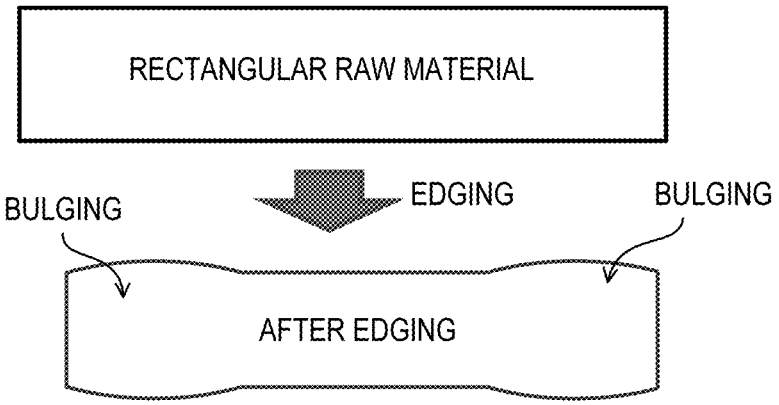
FIG. 18 An explanatory view regarding bulging deformation.

FIG. 17 is graphs relating to Example 3, and (a) is a graph indicating the relation between the distance from the bite end and the claw height after the rolling by the fifth caliber K5 in the prior art, (b) is a graph indicating the relation between the distance from the bite end and the claw height after the rolling by the fifth caliber K5 in the case of applying the technique of the present invention, (c) is a graph indicating the relation between the distance from the bite end and the claw caliber width after the rolling by the eighth caliber K8 (product) in the prior art, and (d) is a graph indicating the relation between the distance from the bite end and the claw caliber width after the rolling by the eighth caliber K8 (product) in the case of applying the present invention. Note that as the distance from the bite end illustrated in each of the graphs of FIG. 17 (*a*) to (*d*), a range of the distance from the bite leading edge of 0 to 10 m in the case of the entire length of the material to be rolled of 35 m is illustrated.

Comparison of FIGS. 17(*a*) and (*b*) shows that the variation in claw height at the stage after the rolling by the fifth caliber K5 is conventionally about 4 mm, whereas the variation in claw height is improved to about 1 mm by applying the technique of the present invention.

Comparison of FIGS. 17(*c*) and (*d*) also shows that the variation in claw caliber width of the product is conventionally about 2 mm, whereas the variation in claw caliber width of the product is improved to about 0.8 mm by applying the technique of the present invention.

Consequently, it is found that applying the technique of the present invention suppresses the variations in the shape in the longitudinal direction of the claw part (claw corresponding part) after the claw forming step.

INDUSTRIAL APPLICABILITY

The present invention is applicable to a method for producing a steel sheet pile such as a hat-shaped steel sheet pile, a U-shaped steel sheet pile or the like.

EXPLANATION OF CODES

3 . . . web corresponding part
4, 5 . . . flange corresponding part
6, 7 . . . arm corresponding part
8, 9 . . . joint corresponding part
8*a*, 9*a* . . . claw corresponding part
11 . . . rough rolling mill
12 . . . first intermediate rolling mill
13 . . . second intermediate rolling mill
14 . . . finish rolling mill
32, 42 . . . web facing part (of second caliber)
34, 35, 44, 45 . . . flange facing part (of second caliber)
37, 38, 47, 48 . . . arm facing part (of second caliber)
52, 62 . . . web facing part (of third caliber)
54, 55, 64, 65 . . . flange facing part (of third caliber)
57, 58, 67, 68 . . . arm facing part (of third caliber)
A . . . material to be rolled
B . . . raw material
O . . . thickness center line (of raw material)
K1 to K8 . . . first caliber to eighth caliber
L (L1 to L3) . . . rolling line

What is claimed is:

1. A production method for producing a steel sheet pile by reducing a raw material in a rectangular cross-section, the production method comprising:

a rough rolling step, an intermediate rolling step, and a finish rolling step, wherein:

the rough rolling step comprises a step of bending rolling, and is performed in a rolling mill provided with a caliber configured to perform said bending rolling, the bending rolling comprises of extending a thickness center line length of the raw material, and rolling and shaping the raw material from a rectangular cross-sectional shape to a substantially steel sheet pile cross-sectional shape, thereby producing the steel sheet pile, said bending rolling comprises a step of light reduction rolling, wherein a reduction amount with respect to a predetermined section of a bite end part of the raw material is smaller than a reduction amount with respect to a part other than the predetermined section, and, said light reduction rolling is applied on a section of the raw material of 0.75 m or more from a bite end of the raw material in a longitudinal direction of the raw material.

2. The production method for the steel sheet pile according to claim 1, wherein the bending rolling is performed by reverse rolling in one pass or a plurality of passes, and wherein the light reduction rolling is applied to the one pass or the plurality of passes of the reverse rolling.

3. The production method for the sheet pile according to claim 1, wherein the bending rolling is performed in a plurality of passes, wherein the bending rolling comprises a preceding stage where a flange corresponding part of the raw material is not reduced, and a later stage where the flange corresponding part of the raw material is reduced, and wherein the light reduction rolling is applied to a pass, among said plurality of passes at the preceding stage.

4. The production method for the steel sheet pile according to claim 1, wherein the steel sheet pile is a U-shaped steel sheet pile.

5. The production method for the steel sheet pile according to claim 1, wherein the steel sheet pile is a hat-shaped steel sheet pile.

* * * * *